US007146954B2

(12) United States Patent
Sailer et al.

(10) Patent No.: US 7,146,954 B2
(45) Date of Patent: Dec. 12, 2006

(54) HYDRAULIC VALVE-LASH-ADJUSTING ELEMENT

(75) Inventors: Peter Sailer, Erlangen (DE); Oliver Schnell, Veitsbronn (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 11/105,285

(22) Filed: Apr. 13, 2005

(65) Prior Publication Data

US 2005/0229887 A1 Oct. 20, 2005

(30) Foreign Application Priority Data

Apr. 16, 2004 (DE) ..... 10 2004 018 457

(51) Int. Cl.
*F01L 1/14* (2006.01)

(52) U.S. Cl. ..... 123/90.52; 123/90.46; 123/90.55

(58) Field of Classification Search ..... 123/90.52, 123/90.35, 90.36, 90.46, 90.55
See application file for complete search history.

(56) References Cited

U.S. PATENT DOCUMENTS

| | | | | |
|---|---|---|---|---|
| 4,054,109 | A | 10/1977 | Herrin et al. | |
| 5,758,613 | A * | 6/1998 | Edelmayer et al. | 123/90.35 |
| 5,862,785 | A | 1/1999 | Blowers et al. | |
| 6,203,461 | B1 * | 3/2001 | Watanabe et al. | 474/110 |

FOREIGN PATENT DOCUMENTS

| | | |
|---|---|---|
| DE | 698 13 092 | 3/2004 |
| EP | 1 298 287 | 4/2003 |
| EP | 1 568 852 | 8/2005 |
| JP | 61185607 | 8/1986 |

* cited by examiner

*Primary Examiner*—Thomas Denion
*Assistant Examiner*—Zelalem Eshete
(74) *Attorney, Agent, or Firm*—Charles A. Muserlian

(57) ABSTRACT

A reverse spring hydraulic valve-lash-adjusting element for the valve train of an internal combustion engine having a plunger (1), in the plunger head (2) of which a control valve (5) is arranged, this control valve (5) controlling a central axial bore (6) which connects a low-pressure space (4), arranged above the plunger head (2), to a high-pressure space (3) arranged below the plunger head (2), the control valve (5) having a valve-closing body (7) which is loaded in the opening direction by a valve-body spring (17) and as a result passes from a cylinder-ring-shaped sealing surface (8) arranged on the plunger head (2) to a travel-limit surface (9) of a center piece (24), whereas the closing of the control valve (5) is effected by displacement of oil from the high-pressure space (3) into the low-pressure space (4) wherein the valve-closing body (7) reaches the sealing surface (8) on a linear path without lateral movement or rotation of said valve-closing body (7) by virtue of the fact that a circular-cylindrical and axially parallel guide surface connected to the plunger head (2) is provided, this guide surface enclosing a corresponding guide line (40) of the valve-closing body (7) with guide clearance.

13 Claims, 10 Drawing Sheets

HYDRAULIC VALVE-LASH-ADJUSTING ELEMENT

FIELD OF THE INVENTION

The invention relates to a hydraulic valve-lash-adjusting element for a valve train of an internal combustion engine.

BACKGROUND OF THE INVENTION

Hydraulic valve-lash-adjusting elements serve to adjust the lash which forms due to wear or thermal expansion between the transmission elements of the cam lift and the gas-exchange valves of an internal combustion engine. This is intended to achieve a low-noise and low-wear valve train and the greatest possible conformity of cam rise curve and valve travel curve.

A hydraulic valve-lash-adjusting element for the valve train of an internal combustion engine is disclosed in EP 1 298 287 A2 and is characterized by the following features:

- a housing of a valve-lash-adjusting element has a blind bore in which a plunger is guided with sealing clearance;
- the plunger has a plunger head, which together with the blind bore defines a high-pressure space, whereas a low-pressure space is located above the plunger head;
- the pressure spaces are connected by a central axial opening in the plunger head, this axial opening being controlled by a control valve arranged on the underside of the plunger head;
- the control valve has a valve-closing body which has a hemispherical sealing surface, which together with a cylinder-ring-shaped sealing surface arranged on the plunger head forms a circular sealing line;
- a valve-body spring, which is supported on a step between the central axial bore and a coaxial bore located below the latter, loads the valve-closing body in the opening direction, whereas positive pressure in the high-pressure space loads the valve-closing body in the closing direction;
- a closing-body cap has a cap flange, an essentially cylindrical cap centre piece and a cap base provided with at least one opening;
- the closing-body cap is supported and centred on the plunger head and serves as a travel limit for the valve-closing body;
- pressure is applied to the plunger via the cap flange by a compression spring arranged in the high-pressure space.

Such hydraulic valve-lash-adjusting elements, on account of the reversed arrangement of the closing-body springs compared with conventional hydraulic valve-lash-adjusting elements, are called reverse spring hydraulic valve-lash-adjusting elements and are abbreviated to RSHLA for the description below.

RSHLAs are distinguished by a positive effect on thermodynamics, pollutant emissions and mechanical stressing of the internal combustion engine. An important precondition for satisfactory functioning of the RSHLAS is constant travel and closing pressure of the valve-closing bodies. Constant idle travel of the RSHLAs is achieved as a result.

The valve-body spring of EP 1 298 287 A2 establishing the generics type is designed in such a way that the valve permits a fluid transfer between the high-pressure and low-pressure spaces during assembly of the RSHLA but closes as quickly as possible against the spring force of the valve-body spring when pressure increases in the high-pressure space. This spring force must therefore be relatively low. Therefore the spherical valve-closing body can be set in rotation by a possible lateral incident flow and can be laterally displaced with the valve-body spring. As a result, the closing force of the valve-body spring and consequently the idle travel of the RSHLA are changed. In the extreme case, the valve-body spring may pass into the seating gap of the control valve, which may lead to further variations in the idle travel and to the detuning or even to the total failure of the RSHLA and to the destruction of the valve-body spring.

OBJECT OF THE INVENTION

The object of the invention is to provide an RSHLA which has the advantages of the solution recited in the prior art but avoids its disadvantages.

DESCRIPTION OF THE INVENTION

The object is achieved according to the invention by reverse spring hydraulic valve-lash-adjusting element for the valve train of an internal combustion engine, which is characterized by the following features:

- a housing of a valve-lash-adjusting element has a blind bore in which a plunger (1) is guided with sealing clearance;
- the plunger (1) has a plunger head, (2), which together with the blind bore defines a high-pressure space (3), whereas a low-pressure space (4) is located above the plunger head (2);
- the pressure spaces (3, 4) are connected by a central axial opening (6) in the plunger head (2), this axial opening (6) being controlled by a control valve 95) arranged on the underside of the plunger head (2);
- the control valve (5) has a valve-closing body (7) which has a hemispherical sealing surface, which together with a cylinder-ring-shaped sealing surface (8) arranged on the plunger head (2) forms a circular sealing line;
- a valve-body spring (17), which is supported on a step (19) between the central axial bore (6) and the sealing surface (8) located blow the latter, loads the valve-closing body (7) in the opening direction, whereas a positive pressure in the high-pressure space (3) loads the valve-closing body (7) in the closing direction;
- a closing-body cap (10) has a cap flange (11), an essentially cylindrical cap centre piece (12) and a cap base (13) provided with openings (21);
- the closing-body cap (10) is supported and centered on the plunger head (2), and the cap base (13) serves as a travel limit for the valve-closing body (7);
- pressure is applied to the plunger (1) via the cap flange (11) by a compression spring (23) arranged in the high-pressure space (3), characterized in that a cylindrical and axially parallel guide surface (20, 20*a*) connected to a plunger head (2, 2*a*) is provided, this guide surface (20, 20*aq*) enclosing a corresponding guide line (40) or guide surface (25, 29, 30) of a valve-closing body (7, 7*a*, 7*b*, 7*c*, 7*d*, 7*e*, 7*f*, 7*g*) with guide clearance.

Due to the cylindrical guide surface which encloses the valve-closing body with guide clearance and runs parallel to the axis of the RSHLA, the fluid flow flowing during the closing of the control valve loads the valve-closing body in the closing direction. Its effect is mainly hydrostatic, so that the valve-closing body is moved linearly like a piston.

The fluid flow likewise flowing in an axially parallel manner between the guide surfaces is small and causes the valve-closing body to be centred in its guide surface. In contrast to the hydrostatic and axial loading of a guided valve-closing body, unguided hydrodynamic loading of an unguided valve-closing body can lead to an eccentric position and to a rotational movement of the same with said disadvantages. There is also the fact that a hydrodynamically loaded valve-closing body requires a greater oil quantity for the closing operation than a hydrostatically loaded valve-closing body.

The fact that the valve-body springs can be designed as cylindrical or conical compression springs has advantages with valve-closing bodies of different design.

For the dynamics of the control valve, it may be of interest that the valve-closing body is produced, for example, from titanium or ceramic instead of from steel.

The inside of the cylindrical centre piece of the closing-body cap is suitable as a cylindrical guide surface which can be formed without chip removal and is connected to the plunger head.

It is advantageous that the underside of the plunger head has a concentric bore which extends up to the cylinder-ring-shaped sealing surface and has a shoulder, on which the cap flange, which is centred in the bore, rests. In this way, the axial and the radial position of the closing-body cap is fixed.

An advantageous further development consists in the fact that the valve-closing body is designed as a ball or as a ball (a "needle") extended by a circular-cylindrical intermediate piece, and that the cap base has a centre piece serving as travel limit and having openings arranged in a rotationally symmetrical manner around the said centre piece and preferably designed as holes. The holes arranged in a rotationally symmetrical manner provide for a uniform, axial inflow of the pressure oil to the valve-closing body, which in this way is not set in rotation.

Rotation about a horizontal axis is additionally prevented in the case of the needle by the axially guided circular-cylindrical intermediate piece of the same.

It is also advantageous if the valve-closing body has an extended circular-cylindrical intermediate piece and a flattened end remote from the valve seat, and the closing-body cap has a cap base having a central opening which is preferably designed as a central hole and whose edge region serves as a travel limit for the valve-closing body. The axial positive guidance of the valve-closing body by the extended circular-cylindrical intermediate piece automatically prevents rotation about a horizontal axis.

An advantageous design of the invention consists in the fact that the valve-closing body of a control valve has a, for example circular-cylindrical, stem at its end remote from the valve seat, the diameter of this stem corresponding with guide clearance to the diameter of the central hole of the closing-body cap, and the length of this stem being greater than the travel of the valve-closing body. This ensures exact axial guidance during the entire travel of the valve-closing body.

If the stem and the hole matching it do not have a circular-cylindrical form, positive rotary locking can also be achieved about the longitudinal axis of the valve-closing body. Suitable profiles are, for example, angular, polygonal or tooth-shaped cylinder profiles.

The same effect can also be achieved without the stem but with corresponding profiling of the cylindrical intermediate piece of the valve-closing body and its guide surface.

A design of the valve-closing body that is locked against rotation about all the axes is achieved by the said valve-closing body having at least one lateral profiled portion running axially parallel, preferably a flat. The flat offers production advantages; however, any other desired cylindrical profiles running in an axially parallel manner are also conceivable.

All the embodiments of the valve-closing body, including the ball, are suitable for the flattening or for any other desired cylindrical profiling.

A further design of the valve-closing body locked against rotation about all the axes consists in the fact that, in addition to its extended, circular-cylindrical intermediate piece, the said valve-closing body has at least one eccentric cutout which is free of undercuts towards the bottom and corresponds with a corresponding step of the closing-body cap. The cutout provides anti-rotation locking about the longitudinal axis, whereas the freedom from undercuts is a prerequisite for the axial mobility of the valve-closing body.

The overall height of the control valve is reduced if the valve-closing body has a shallow spherical segment as sealing surface and an adjoining, flattened end as a stop for the travel limit at the cap base of the closing-body cap, and if the latter is of plate-shaped design. This embodiment of the valve-closing body approaches that of a plate valve. Its tilt resistance can be ensured by a stem which fits with guide clearance into the opening of the cap base.

An embodiment of the valve-closing body that is locked against rotation about a horizontal axis consists in the fact that the said valve-closing body has a spherical shape with opposite, preferably circular-cylindrical recesses, the recess close to the valve seat serving as a support for the conical valve-body spring, and the recess remote from the valve seat corresponding with a central guide lug of the cap base and serving as a step and guide for the valve-closing body.

An advantageous further development of the invention consists in the fact that a cylindrical guide surface connected to a plunger head is a concentric bore which is incorporated in an underside of the plunger head, extends up to a cylinder-ring-shaped sealing surface and encloses at least the guide line or the guide surface of the valve-closing body with guide clearance, and that a closing-body cap is centred with its cylindrical cap centre piece on an end part, reduced in outside diameter, of the plunger head, and a cap flange rests on a shoulder of the reduced end part and a cap base rests on the underside of the plunger head.

In this solution, the closing-body cap of the valve-closing body merely serves as a travel limit and for the uniform oil feed. However, it is also conceivable for a profiled stem on the underside of the valve-closing body, in combination with a corresponding central opening in the cap base, to provide tilt resistance about a horizontal axis and at the same time anti-rotation locking about the longitudinal axis.

An advantage for rapid fluid transfer between the high-pressure and low-pressure spaces consists in the fact that the concentric bore of a control valve has an enlarged diameter in the region of its bottom end up at least to the top end of the circular-cylindrical guide surface or up to the circular guide line of the valve-closing body bearing against the travel-limit surface. A correspondingly designed valve-body spring moves the valve-closing body up to its travel limit and thus into the region of the internal-diameter increase, which permits unchoked fluid transfer between the pressure spaces.

It is advantageous for a flexible configuration of the control valve, this configuration permitting numerous variants, that those features of the individual control valves which are relevant for the guidance can be exchanged or combined.

An advantage for cost-effective series production is offered by a method of equalizing the valve travel of the valve-closing body in that the actual travel of the control valve is measured by means of a master valve-closing body, and the desired travel is set by corresponding paired valve-closing bodies.

A further method of equalizing the valve travel of the valve-closing body consists in the fact that the actual travel of the control valve is measured and the desired travel is set by subsequently pressing the cap base of the closing-body cap.

BRIEF DESCRIPTION OF THE DRAWING

Further features of the invention follow from the description below and the drawings, in which exemplary embodiments of the invention are schematically shown.

In the drawings.

DETAILED DESCRIPTION OF THE DRAWINGS

Figure 1:
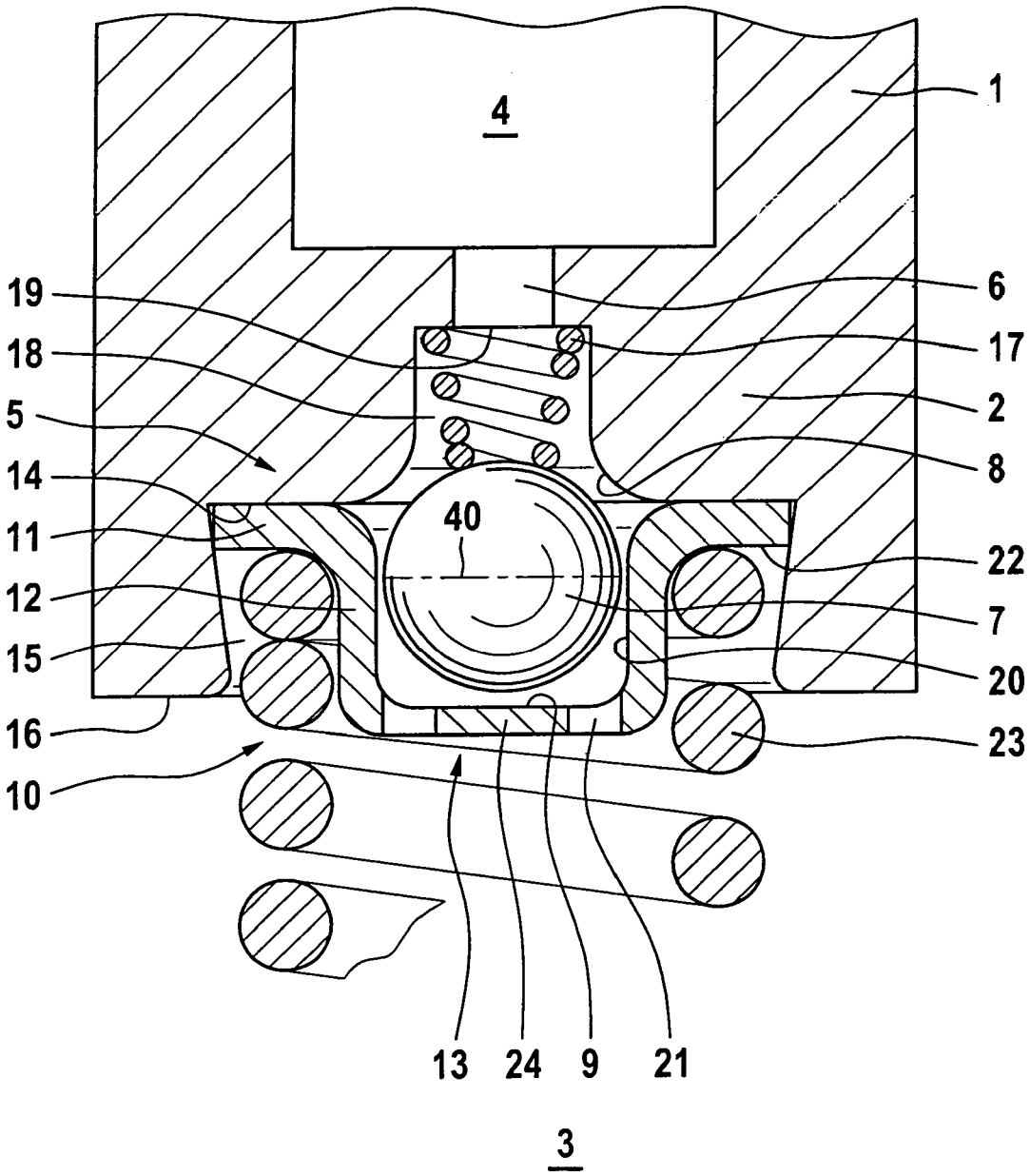
FIG. 1 shows a longitudinal section through a bottom part of a plunger having a plunger head, a control valve, a valve-closing body designed as a ball, and a cap base having a plurality of holes.

Shown in FIG. 1 is a longitudinal section through a bottom part of a plunger 1 which is an integral part of an RSHLA (not shown), in the blind bore of which the plunger 1 is guided with sealing clearance.

The plunger 1 has a plunger head 2, which separates a high-pressure space 3, arranged below the plunger 1 in the blind hole (not shown), from a low-pressure space 4 arranged in the plunger 1 above the plunger head 2.

Located in the plunger head 2 is a control valve 5 which controls a central axial bore 6 connecting the two pressure spaces 3 and 4.

The control valve 5 has a spherical valve-closing body 7, which moves between a cylinder-ring-shaped sealing surface 8, arranged on the plunger head 2, and a travel-limit surface 9. The spherical valve-closing body 7 and the cylinder-ring-shaped sealing surface 8 touch one another at a circular sealing line.

The travel-limit surface 9 is part of a closing-body cap 10, which has a cap flange 11, a cylindrical cap centre piece 12 and a cap base 13.

The cap base 13 has a centre piece 24, the inside of which is the travel-limit surface 9 and which is surrounded by uniformly distributed holes 21.

The cap flange 11 bears against a shoulder 14 of a concentric recess 15, which is incorporated in the plunger head 2 from the underside of the latter. The cap flange 11 is centred in the recess 15. Since the concentric recess 15 is drawn in slightly, the closing-body cap 10 is clipped in place during assembly and is axially fixed as a result.

The inside of the cylindrical cap centre piece 12 serves as a guide surface 20 which is fixed to the plunger head and encloses the circular guide line 40 of the spherical valve-closing body 7 with guide clearance. The shoulder 14 may also be incorporated deeper in the plunger head 2 in order to reduce the axial distance between the guide surface 20, fixed to the plunger head, and the cylindrical sealing surface 8 and thus ensure the guidance of the valve-closing body 7 until the control valve 5 is closed.

A coaxial axial bore 18 arranged below the central axial bore 6 forms a step 19, on which a valve-body spring 17 is supported. The latter loads the spherical valve-closing body 7 in the opening direction. The spherical valve-closing body 7 and its guide surface 20 may have at least one axially parallel flat (not shown) for preventing rotation about the vertical axis.

Located in the high-pressure space 3 is a compression spring 23, which applies pressure to the plunger 1 via the cap flange 11.

The control valve 5 according to the invention functions as follows:

In the lift phase of the cam, the high-pressure space 3 is under pressure. The latter also acts on the valve-closing body 7, which bears against its sealing surface 8. On account of the high pressure, a certain oil quantity escapes through the sealing gap between the plunger 1 and the blind bore. As a result, the RSHLA is compressed somewhat, so that the valve train has valve lash during the subsequent base circle phase of the cam. In this way, the high-pressure space 3 is pressure-relieved and the plunger 1 is moved by means of the compression spring 23 out of the blind hole until the valve lash is bridged. As a result, a vacuum forms in the high-pressure space 3. Due to this vacuum and due to the spring force of the valve-body spring 17, the valve-closing body 7 is moved in the direction of the travel-limit surface 9. The path is thus free for the oil flow, which passes from the low-pressure space 4 through the bores 6 and 18 between the valve-closing body 7 and the guide surface 20 and through the holes 21 into the high-pressure space 3.

During the next lift phase, first of all the control valve 5 must be closed by displacing the spherical valve-closing body 7. This is done by displacing a small oil quantity through the holes 21, as a result of which the valve-closing body 7 is hydrostatically moved uniformly as a piston towards the sealing surface 8 against the spring force of the valve-body spring 17. In the process, the guide surface 20 prevents lateral displacement of the spherical valve-closing body 7, the uniform, hydrostatic loading of the latter also preventing its rotation about a horizontal or vertical axis. This effect can also be assisted by lateral flats of the spherical valve-closing body 7 and of the matching guide surface 20.

Due to the design of the control valve 5 according to the invention, a change in the closing forces of the valve-closing body 7 and thus a variation in the idle travel of the RSHLA are avoided. In addition, jamming of the valve-body spring 17 between the spherical valve-closing body 7 and its sealing surface 8 and thus detuning of the basic design or even total failure of the RSHLA are prevented.

Figure 2:
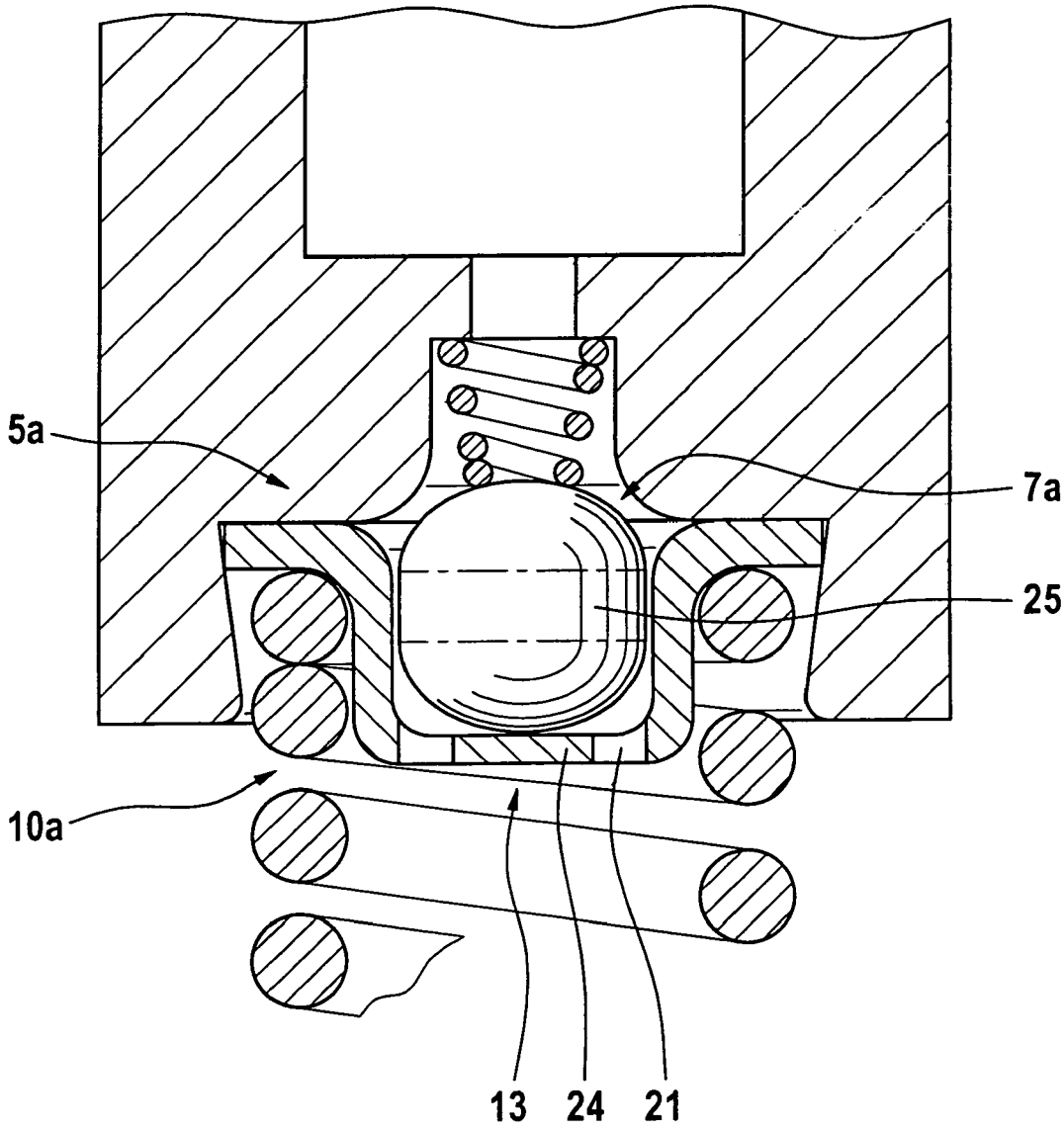
FIG. 2 shows a longitudinal section as in FIG. 1, but with a ball extended by a circular-cylindrical intermediate piece as valve-closing body.

The concept shown in FIG. 1 is modified in FIGS. 2 to 8 by changes to the valve-closing body and the associated closing-body cap or guide surface. Shown in FIG. 2 is a control valve 5*a* with a valve-closing body 7*a* which is designed as a ball (a "needle") extended by a circular-cylindrical intermediate piece 25. The valve-closing body 7*a* is distinguished by its positive longitudinal guidance. A closing-body cap 10*a* largely corresponds to the closing-body cap 10 of FIG. 1. The closing-body cap 10*a* also has a cap base 13 with a centre piece 24 as travel limit, the centre piece 24 being surrounded by holes 21.

Figure 3:
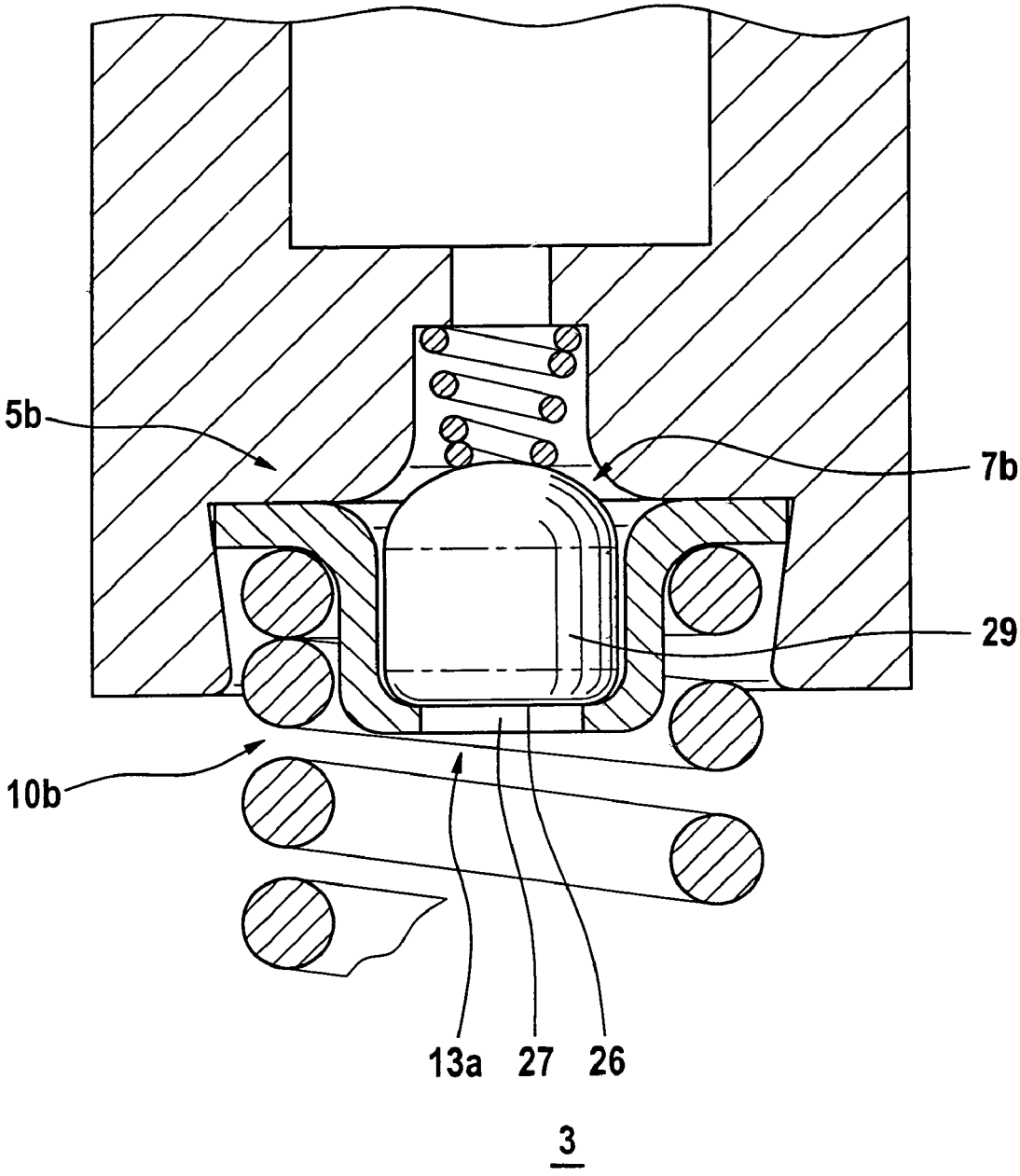
FIG. 3 shows a longitudinal section as in FIG. 2, but with an extended circular-cylindrical intermediate piece and a flattened end and also a cap base with a central hole.

The control valve 5*b* shown in FIG. 3 has a valve-closing body 7*b* with an extended, circular-cylindrical intermediate piece 29 and a flattened end 26 remote from the valve seat.

A closing-body cap 10*b* has a central hole 27 in the cap base 13*b*, the edge region of which serves as travel limit for the valve-closing body 7*b*. The central hole 27 also ensures that the oil flowing out of the high-pressure space 3 is admitted uniformly to the valve-closing body. The valve-closing body 7*b* is also characterized by positive longitudinal guidance.

Figure 4:
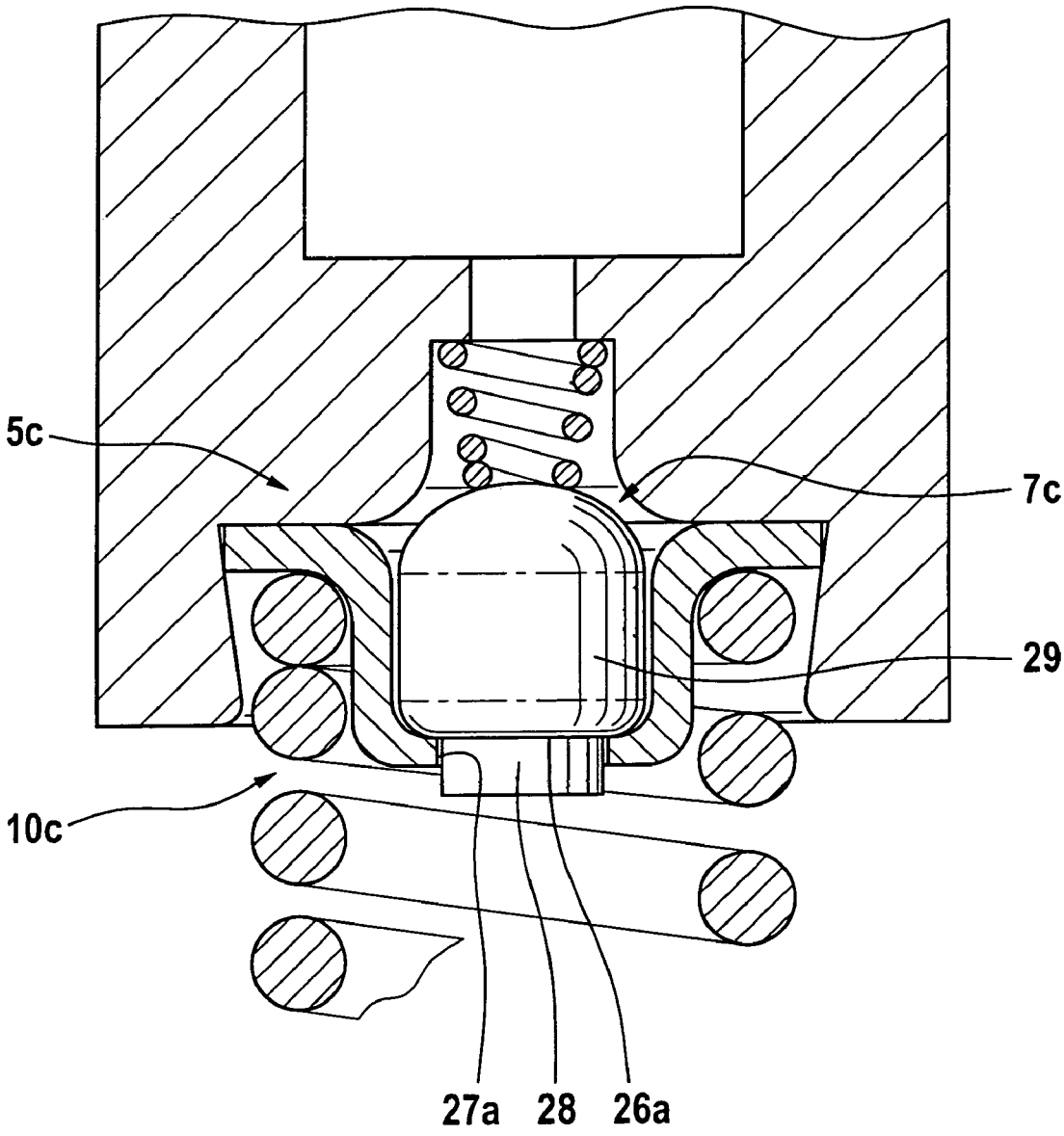
FIG. 4 shows a longitudinal section as in FIG. 3, but the valve-closing body, at its end remote from the valve seat, has a circular-cylindrical stem, the diameter of which corresponds with guide clearance to the diameter of the central hole.

FIG. 4 shows a control valve 5*c* whose valve-closing body 7*c*, in contrast to FIG. 3, has a circular-cylindrical stem 28 at its end 26*a* remote from the valve seat, the diameter of this stem 28 corresponding with guide clearance to the diameter of a central hole 27*a* of the closing-body cap 10*c*, and the length of this stem 28 being greater than the travel of the valve-closing body 5*c*. The circular-cylindrical intermediate piece 29 and the circular-cylindrical stem 28 serve for the positive longitudinal guidance of the valve-closing body 7*c*. By complementary profiling of the stem 28 and the central hole 27*a*, additional anti-rotation locking of the valve-closing body 7*c* about its longitudinal axis can be achieved.

Figure 5:
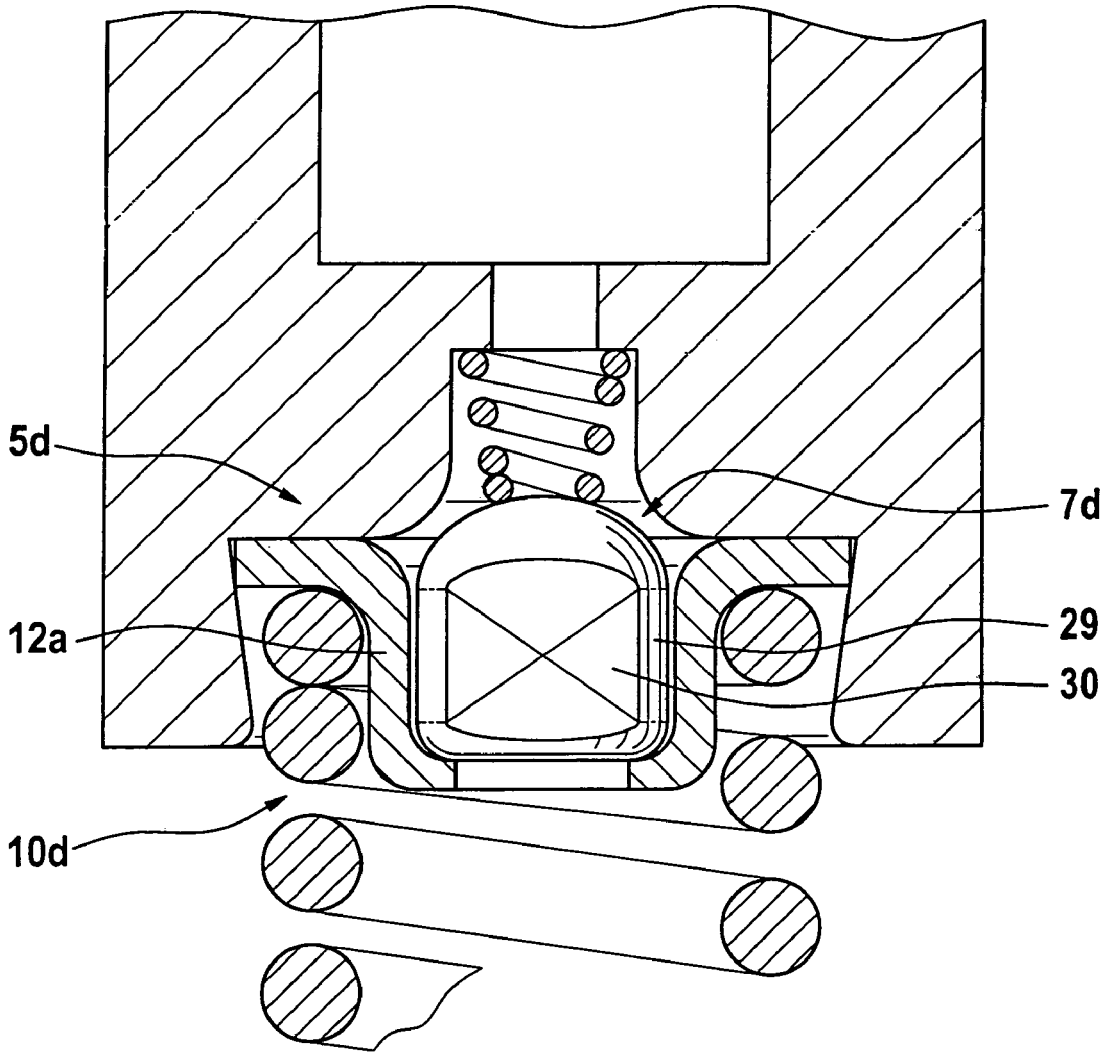
FIG. 5 shows a longitudinal section as in FIG. 3, but the valve-closing body has a lateral flat running in an axially parallel manner.

FIG. 5 shows a control valve 5*d* whose valve-closing body 7*d* has a lateral, axially parallel flat 30 in the region of its extended, circular-cylindrical intermediate piece 29, the mating surface of this flat 30 being arranged on the inner circumference of the cap centre piece 12*a*. The number of flats may of course also be greater, two opposite flats being suitable from the production point of view. All serve to prevent rotation of the valve-closing body 7*d* about its longitudinal axis and about horizontal axes.

Figure 6:
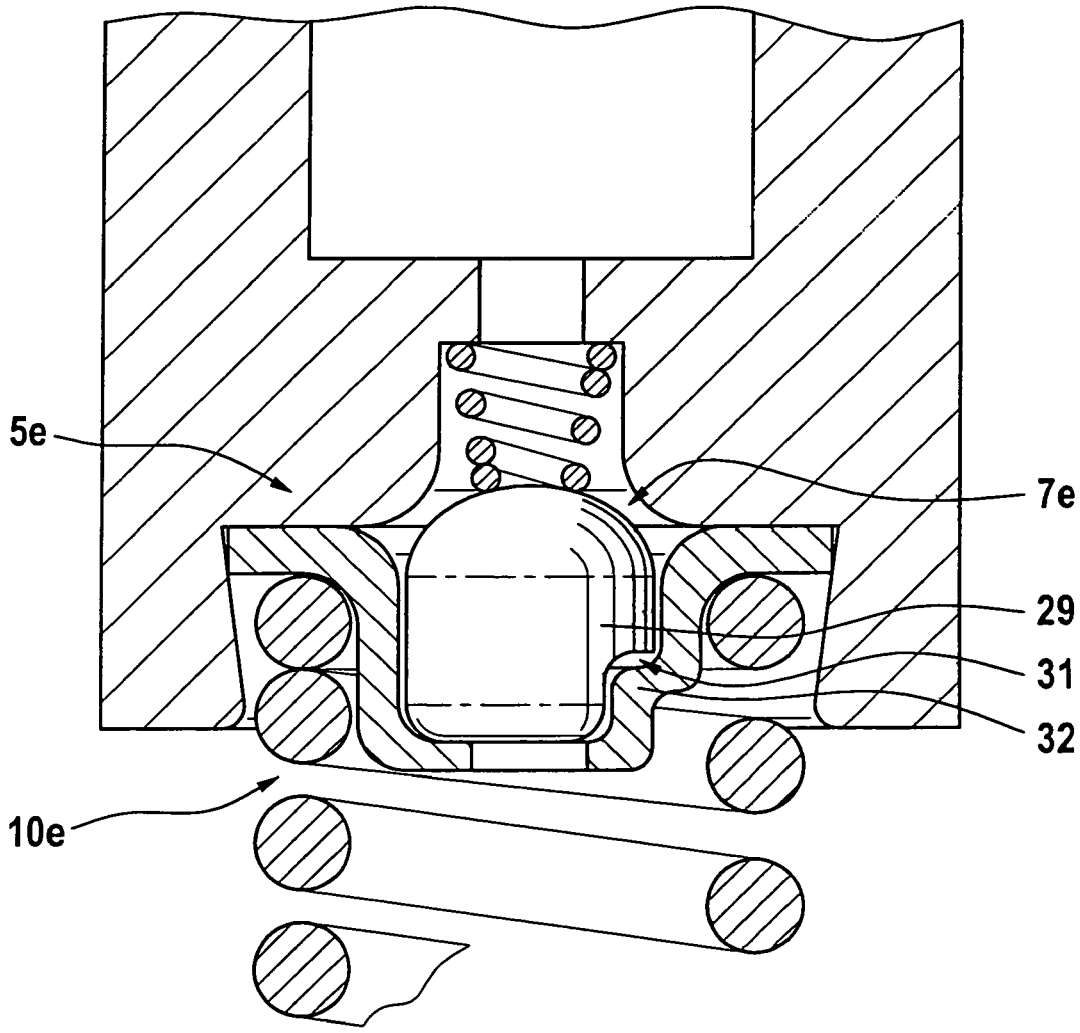
FIG. 6 shows a longitudinal section as in FIG. 3, but with a valve-closing body which has an eccentric cutout free of undercuts towards the bottom.

Shown in FIG. 6 is a control valve 5*e* whose valve-closing body 7*e* has an eccentric cutout 31 which is free of undercuts towards the bottom and interacts with a corresponding step 32 of the closing-body cap 10*e*. In combination with the step 32, the cutout 31 prevents rotation of the valve-closing body 7*e* about its longitudinal axis, and the circular-cylindrical, extended intermediate piece 29 prevents tilting of the valve-closing body 7*e*.

Figure 7:
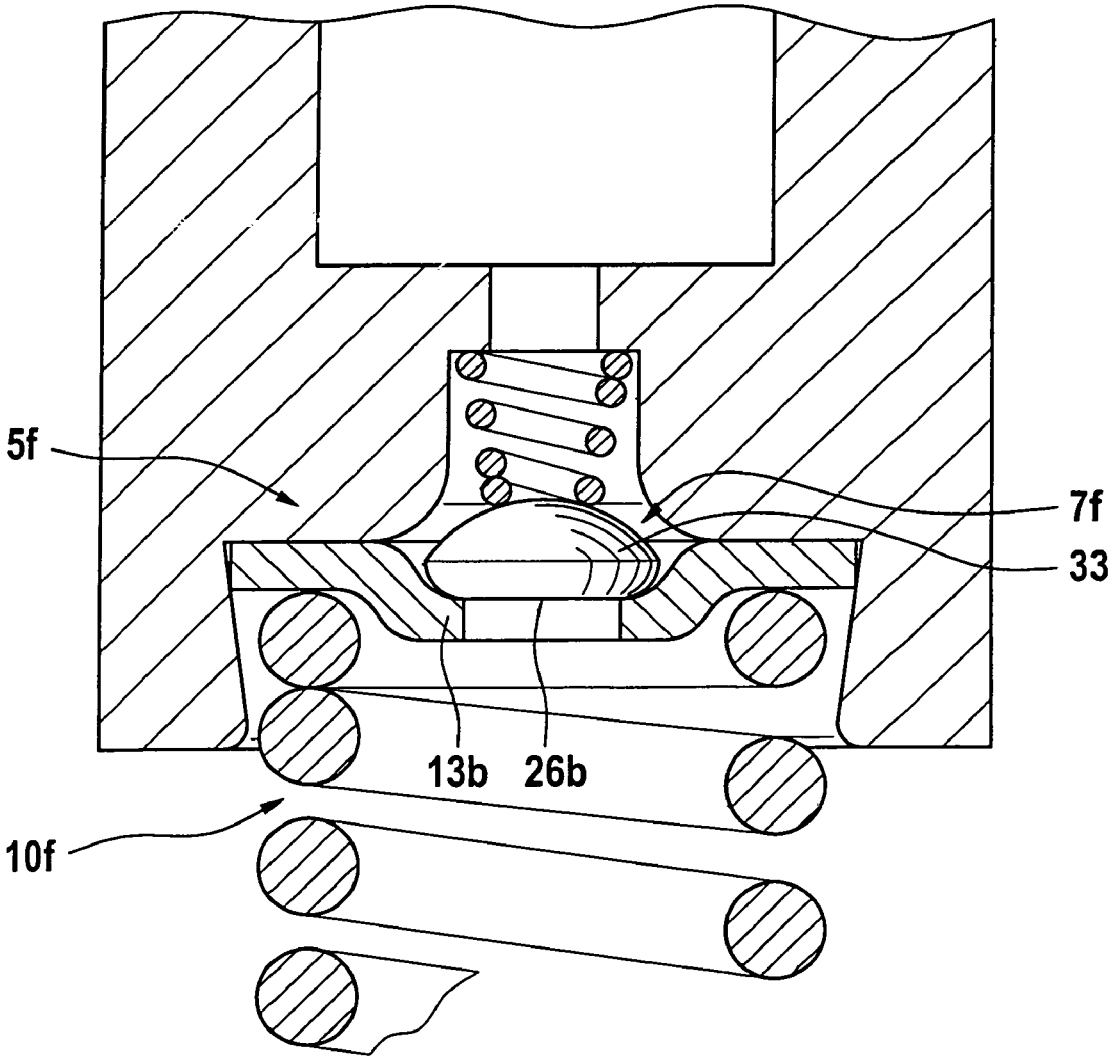
FIG. 7 shows a longitudinal section as in FIG. 3, but with a control valve whose valve-closing body has a shallow spherical segment and whose closing-body cap is of plate-shaped design.

FIG. 7 shows a control valve 5*f* having a valve-closing body 7*f* which has a shallow spherical segment 33 as sealing surface and an adjoining, flattened end 26*b*, remote from the valve seat, as stop for the travel limit at the cap base 13*a* of the closing-body cap 10*f*. The shallow, plate-shaped closing-body cap 10*f* together with the tilt-resistant valve-closing body 7*f* of shallow construction permits a small overall height of the control valve 5*f*.

Figure 8:
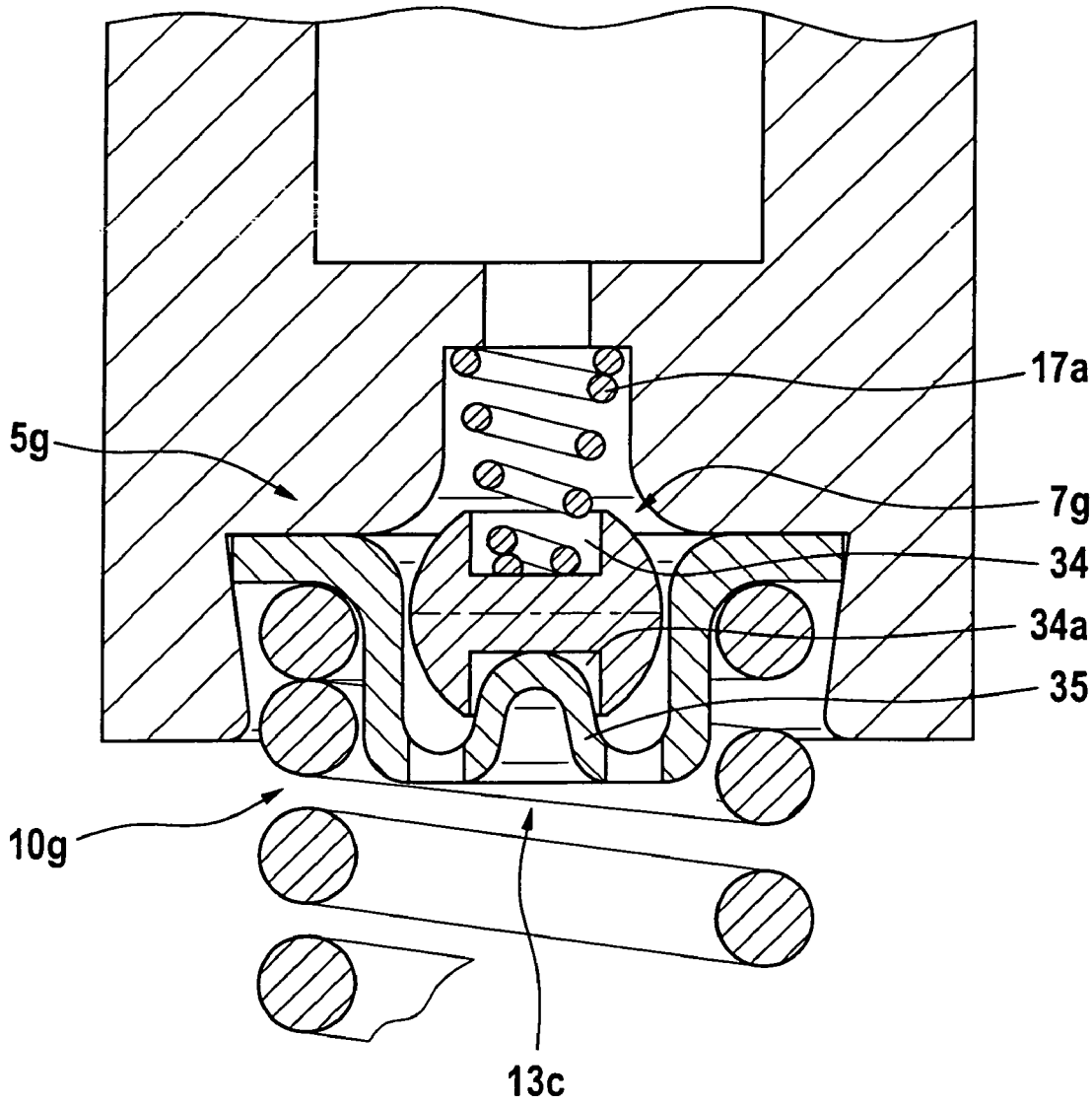
FIG. 8 shows a longitudinal section as in FIG. 1, but with a valve-closing body which has opposite cylindrical recesses for a valve-body spring and a guide lug of the cap base.

Shown in FIG. 8 is a control valve 5*g* having a valve-closing body 7*g* which has a spherical shape with opposite circular-cylindrical recesses 34, 34*a*. The recess 34 close to the valve seat serves as a support for the conical valve-body spring 17*a*, and the recess 34*a* which is remote from the valve seat, and which interacts with a central guide lug 35 of a cap base 13*c* of a closing-body cap 10*g*, serves as a stop for the valve-closing body 7*g* and makes rotation of the latter about the longitudinal axis more difficult.

Figure 9:
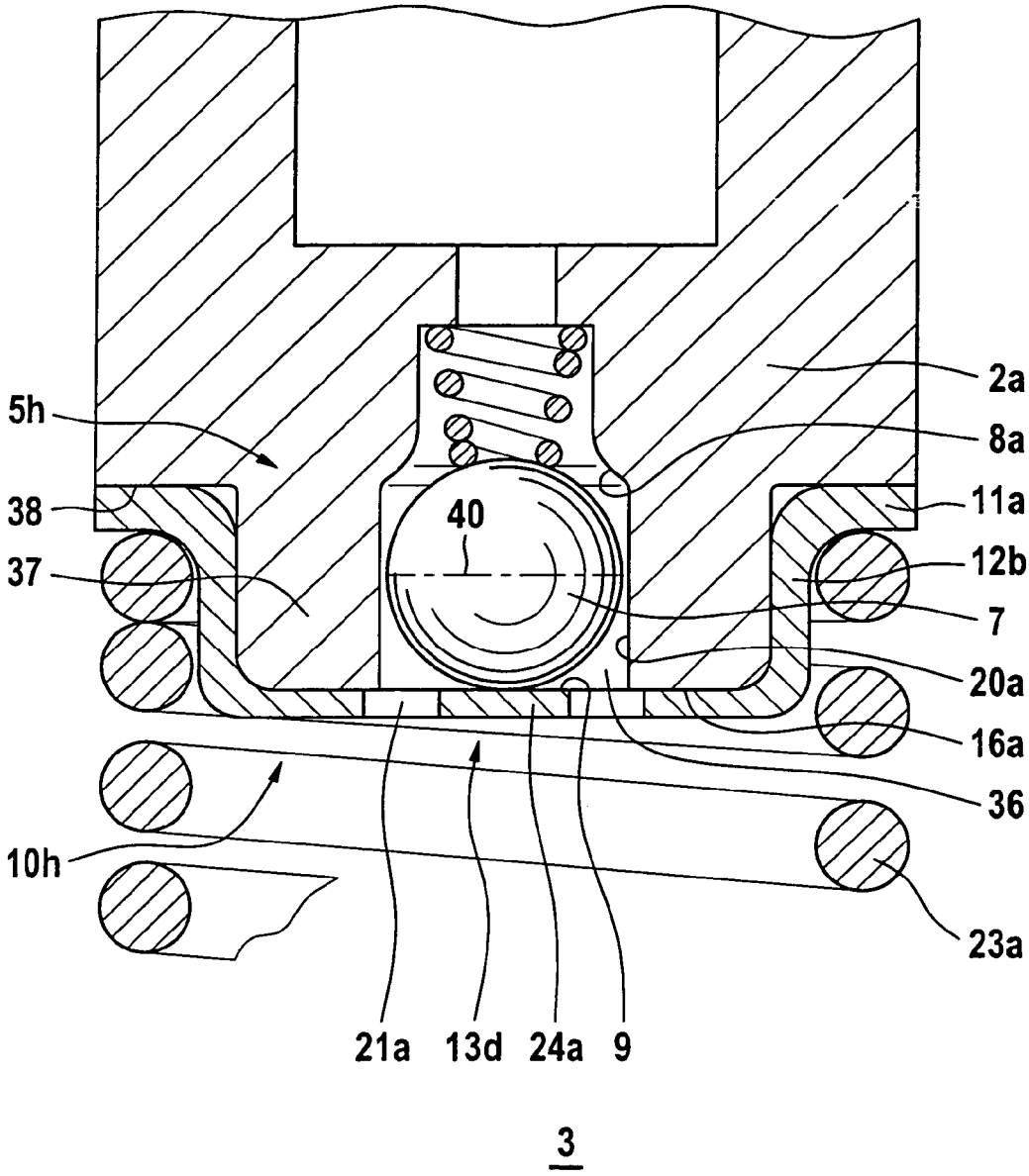
FIG. 9 shows a longitudinal section through a plunger head having a control valve whose guide surface connected to the plunger head is the surface of a central bore incorporated in the plunger head from below.

FIG. 9 shows a control valve 5*h* having a spherical valve-closing body 7 which is guided in a central and axially parallel bore 36 which is incorporated in an underside 16*a* of a plunger head 2*a*. Serving here as cylindrical and axially parallel guide surface 20*a* fixed to the plunger head is the inner surface of the bore 36, which surrounds the spherical valve-closing body 7 with guide clearance. The bore 36 extends up to a cylinder-ring-shaped sealing surface 8*a* of the plunger head 2*a*. As a result, the valve-closing body 7 is guided in an axially parallel manner with its guide line 40 until it bears against the sealing surface 8*a* and is prevented from rotating.

A closing-body cap 10*h* is centred with its cylindrical cap centre piece 12*b* on an end part 37, reduced in outside diameter, of the plunger head 2*a*. Under the pressure of a compression spring 23*a* arranged in the high-pressure space 3, a cap flange 11*a* bears against a shoulder 38 of the reduced end part 37, whereas a cap base 13*d* rests on the underside 16*a* of the plunger head 2*a*. A concentric centre piece 24*a* surrounded by holes 21*a* and having a travel-limit surface 9 serves as a travel limit for the valve-closing body 7.

The functioning of the control valve 5*h* corresponds to the control valve 5 of FIG. 1 described above.

Figure 10:
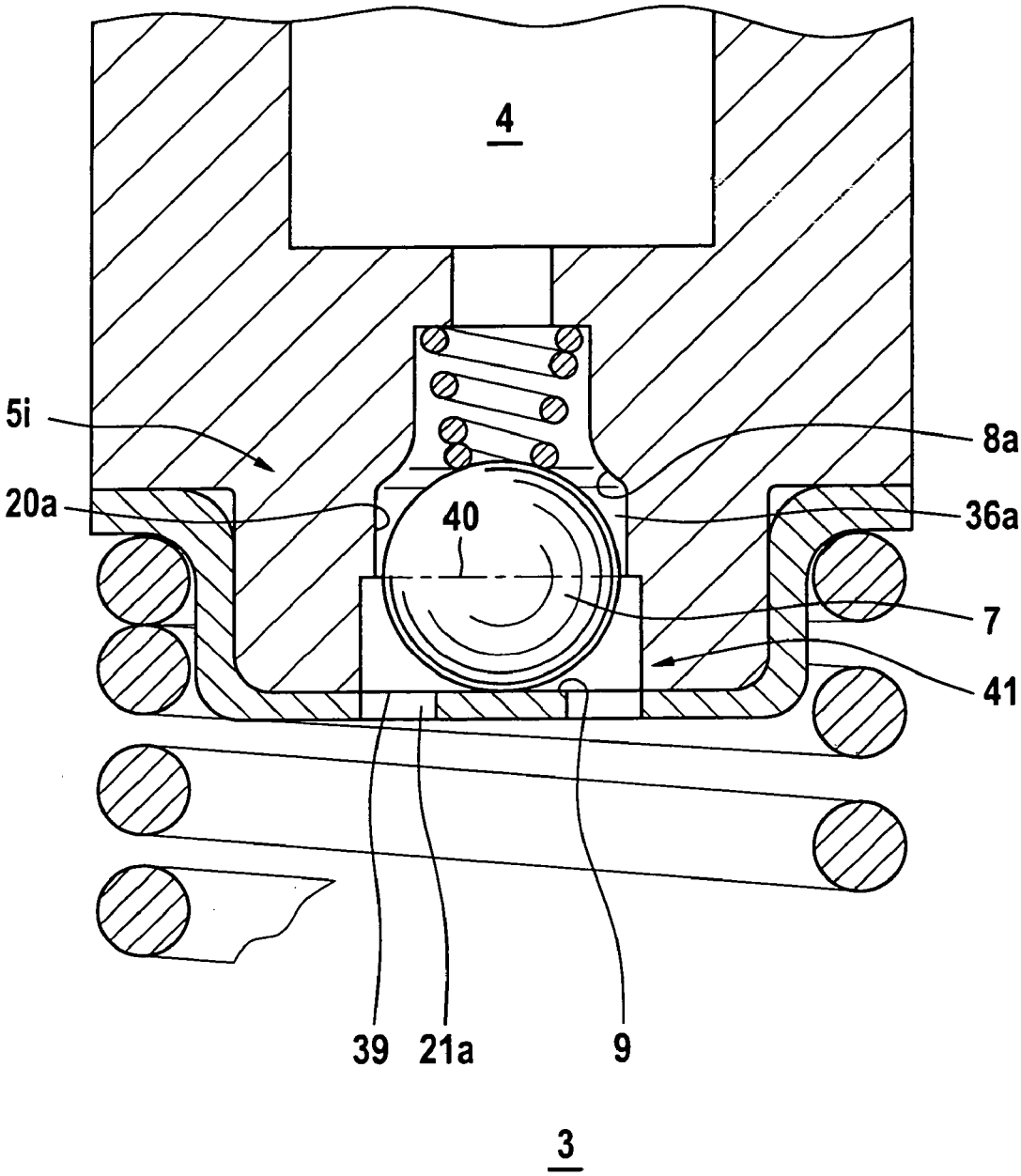
FIG. 10 is a longitudinal section as in FIG. 9, but with the concentric bore being increased in diameter from the bottom end of the same up to the top end of the cylindrical guide surface of the valve-closing body bearing against the travel limit.

FIG. 10 shows a control valve 5*i* whose valve-closing body 7 bears against the travel-limit surface 9 and whose bore 36*a* has a widened inside diameter 41 in the region of its bottom end 39 up to the top end of the circular-cylindrical guide surface 25, 29 of the valve-closing body 7*a*, 7*b*, (see FIGS. 2 and 3) or up to the circular guide line 40 of the valve-closing body 7. In the position shown of the valve-closing body 7, due to the cross-sectional widening of the bore 36, largely undisturbed substance transfer takes place between the high-pressure and low-pressure spaces 3, 4 along the valve-closing body 7. During the closing operation of the control valve 5*i*, the valve-closing body 7 is guided through the bore 36*a* on the closing path from the travel-limit surface 9 up to the cylinder-ring-shaped sealing surface 8*a*. The valve-closing body 7 is driven by the uniform inflow of oil from the high-pressure pressure space 3 via the holes 21*a* at the start of the cam lift until the control valve 5*i* closes. The uniform loading of the spherical valve-closing body 7 prevents a rotary movement of the same and leads to rapid closing of the control valve 5*i*.

LIST OF DESIGNATIONS

1 Plunger
2 Plunger head
2*a* Plunger head
3 High-pressure space
4 Low-pressure space
5 Control valve
5*a* Control valve
5*b* Control valve

5*c* Control valve
5*d* Control valve
5*e* Control valve
5*f* Control valve
5*g* Control valve
5*h* Control valve
5*i* Control valve
6 Central axial bore
7 Valve-closing body
7*a* valve-closing body
7*b* Valve-closing body
7*c* Valve-closing body
7*d* Valve-closing body
7*e* Valve-closing body
7*f* Valve-closing body
7*g* Valve-closing body
8 Cylinder-ring-shaped sealing surface
8*a* Cylinder-ring-shaped sealing surface
9 Travel-limit surface
10 Closing-body cap
10*a* Closing-body cap
10*b* Closing-body cap
10*c* Closing-body cap
10*d* Closing-body cap
10*e* Closing-body cap
10*f* Closing-body cap
10*g* Closing-body cap
10*h* Closing-body cap
11 Cap flange
11*a* Cap flange
12 Cap centre piece
12*a* Cap centre piece
12*b* Cap centre piece
13 Cap base
13*a* Cap base
13*b* Cap base
13*c* Cap base
13*d* Cap base
14 Shoulder
15 Concentric bore
16 Underside
16*a* Underside
17 Valve-body spring
17*a* Valve-body spring
18 Coaxial axial bore
19 Step
20 Guide surface fixed to plunger head
20*a* Guide surface fixed to plunger head
21 Hole
21*a* Hole
22 Underside
23 Compression spring
23*a* Compression spring
24 Centre piece
24*a* Centre piece
25 Circular-cylindrical intermediate piece
26 End remote from the valve seat
26*a* End remote from the valve seat
26*b* End remote from the valve seat
27 Central hole
27*a* Central hole
28 Circular-cylindrical stem
29 Extended circular-cylindrical intermediate piece
30 Flat
31 Cutout
32 Step
33 Shallow spherical segment
34 Recess
34*a* Recess
35 Guide lug
36 Bore
36*a* Bore
37 End part
38 Shoulder
39 Bottom end
40 Guide line
41 inside diameter

The invention claimed is:

1. A reverse spring hydraulic valve-lash-adjusting element for the valve train of an internal combustion engine, which is characterized by the following features:

a housing of a valve-lash-adjusting element has a blind bore in which a plunger (1) is guided with sealing clearance;

the plunger (1) has a plunger head, (2), which together with the blind bore defines a high-pressure space (3), whereas a low-pressure space (4) is located above the plunger head (2);

the pressure spaces (3, 4) are connected by a central axial opening (6) in the plunger head (2), this axial opening (6) being controlled by a control valve (5) arranged on the underside of the plunger head (2);

the control valve (5) has a valve-closing body (7) which has a hemispherical sealing surface, which together with a cylinder-ring-shaped sealing surface (8) arranged on the plunger head (2) forms a circular sealing line;

a valve-body spring (17), which is supported on a step (19) between the central axial bore (6) and the sealing surface (8) located blow the latter, loads the valve-closing body (7) in the opening direction, whereas a positive pressure in the high-pressure space (3) loads the valve-closing body (7) in the closing direction;

a closing-body cap (10) has a cap flange (11), an essentially cylindrical cap centre piece (12) and a cap base (13) provided with openings (21);

the closing-body cap (10) is supported and centered on the plunger head (2), and the cap base (13) serves as a travel limit for the valve-closing body (7);

pressure is applied to the plunger (1) via the cap flange (11) by a compression spring (23) arranged in the high-pressure space (3), characterized in that a cylindrical and axially parallel guide surface (20, 20*a*) connected to a plunger head (2, 2*a*) is provided, this guide surface (20, 2O*aq*) enclosing a corresponding guide line (40) or guide surface (25, 29, 30) of a valve-closing body (7, 7*a*, 7*b*, 7*c*, 7*d*, 7*e*, 7*f*, 7*g*) with guide clearances the valve-body springs (17, 17*a*) are cylindrical or conical compression springs and the cylindrical guide surface (20, 20*a*) connected to the plunger head (2) is the inside of the cylindrical cap center piece (12, 12*a*, 12*b*) of the closing-body cap (10, 10*a*, 10*b*, 10*c*, 10*d*, 10*e*, 10*f*, 10*g*) wherein the underside (16) of the plunger head (2) has a concentric bore (15) which extends up to the cylinder-ring-shaped sealing surface (8) and has a shoulder (14), on which the cap flange (11), which is centered in the bore (15), rests, the valve-closing body (7, 7*a*) of a control valve (5, 5*a*) is designed as a ball (a "needle") extended by a circular-cylindrical intermediate piece (25), and in that the cap base (13) has a centerr piece (24) serving as travel limit and having openings arranged in a rotationally symmetrical manner around the said center piece (24) designed as holes (21).

2. A reverse spring hydraulic valve-lash-adjusting element according to claim 1, wherein the valve-closing body (7, 7*a*, 7*b*, 7*c*, 7*d*, 7*e*, 7*f*, 7*g*) is produced, from titanium or ceramic instead of from steel.

3. A reverse spring hydraulic valve-lash-adjusting element according to claim 2, wherein a cylindrical guide surface (20*a*) connected to a plunger head (2*a*) is a concentric bore (36) which is incorporated in an underside (16*a*) of the plunger head (2*a*), extends up to a cylinder-ring-shaped sealing surface (8*a*) and encloses at least the guide line (40) or the guide surface (25, 29) of the valve-closing body (7, 7*a*, 7*b*, 7*c*) of the control valves (5, 5*a*, 5*b*, 5*c*) with guide clearance, and in that a closing-body cap (10*h*) is centered with its cylindrical cap center pieces (12*b*) on an end part (37), reduced in outside diameter, of the plunger head (2*a*), and a cap flange (11*a*) rests on a shoulder (38) of the reduced end part (37) and a cap base (13*d*) rests on the underside (16*a*) of the plunger head (2*a*).

4. A reverse spring hydraulic valve-lash-adjusting element according to claim 3, wherein the concentric bore (36), with its guide surface (20*a*) of a control valve (5*i*), has an enlarged diameter (41) in the region of its bottom end (39) up at least to the top end of the circular-cylindrical guide surface (25, 29) or up to the circular guide line (40) of the valve-closing body (7, 7*a*, 7*b*) bearing against the travel-limit surface (9).

5. A reverse spring hydraulic valve-lash-adjusting element according to claim 1 wherein the valve-closing body (7*b*) of a control valve (5*b*) has an extended circular-cylindrical intermediate piece (29) and a flattened end (26) remote from the valve seat, and the closing-body cap (10*b*) has a cap base (13*a*) having a central opening which is preferably designed as a central hole (27) and whose edge region serves as a travel limit for the valve-closing body (7*b*).

6. A reverse spring hydraulic valve-lash-adjusting element according to claim 5, wherein the valve-closing body (7*c*) of a control valve (5*c*) has a, for example circular-cylindrical, stem (28) at its end (26*a*) remote from the valve seat, the diameter of this stem (28) corresponding with guide clearance to the diameter of the central hole (27) of the closing-body cap (10*c*) and the length of this stem (28) being greater than the travel of the valve-closing body (7*c*).

7. A reverse spring hydraulic valve-lash-adjusting element according to claim 5, wherein the valve-closing body (7*d*) of a control valve (5*d*) in the region of its extended, circular-cylindrical intermediate piece (29), has at least one latetal, axially parallel profiled portion preferably designed as a flat (30).

8. A reverse spring hydraulic valve-lash-adjusting element according to claim 5, wherein the valve-closing body (7*e*) of a control valve (5*e*) has at least one eccentric cutout (31) which is free of undercuts towards the bottom and corresponds with a corresponding step (32) of the closing-body cap (10*e*).

9. A reverse spring hydraulic valve-lash-adjusting element according to claim 1, wherein the valve-closing body (7*f*) has a shallow spherical segment (33) as sealing surface and an adjoining, flattened end (26*b*) as a stop for the travel limit at the cap base (13*b*) of the closing-body cap (10*f*), and in that the latter is of plate-shaped design.

10. A reverse spring hydraulic valve-lash-adjusting element according to claim 1, wherein the valve-body closing (7*g*) of a control valve (5*g*) has a spherical shape with opposite, preferably circular-cylindrical recesses (34, 34*a*), the recess (34) close to the valve seat serving as a support for the conical valve-body spring (17*a*), and the recess (34*a*) remote from the valve seat corresponding with a central guide lug (35) of the cap vase (13*c*) and serving as a stop and guide for the valve-closing body (7*g*).

11. A reverse spring hydraulic valve-lash-adjusting element according to claim 1, wherein those features of the individual control valves (5, 5*a*, 5*b*, 5*c*, 5*d*, 5*e*, 5*f*, 5*g*, 5*h*, 5*i*) which are relevant for the guidance can be exchanged or combined.

12. A method of equalizing the valve travel of the valve-closing body (7, 7*a*, 7*b*, 7*c*, 7*d*, 7*e*, 7*f*, 7*g*) of the reverse spring hydraulic valve-lash-adjusting element according to claim 1, comprising measuring the actual travel of the control valve (5, 5*a*, 5*b*, 5*c*, 5*d*, 5*e*, 5*f*, 5*g*, 5*h*, 5*i*) by means of a master valve-closing body, and setting the desired travel by corresponding paired valve-closing bodies (7, 7*a*, 7*b*, 7*c*, 7*d*, 7*e*, 7*f*, 7*g*).

13. A method of equalizing the valve travel of the valve-closing body (7, 7*a*–7*g*) of the reverse spring hydraulic valve-lash-adjusting element according to claim 1, comprising measuring the actual travel of the control valve (5, 5*a*–*i*) and setting the desired travel by subsequently pressing the cap base (13, 13*a*–*d*) of the closing-body cap (10, 10*a*–*h*).

* * * * *